US008506319B2

(12) United States Patent
Ritter et al.

(10) Patent No.: US 8,506,319 B2
(45) Date of Patent: Aug. 13, 2013

(54) ACTUATOR FOR A CONNECTOR

(75) Inventors: Christopher D. Ritter, Hummelstown, PA (US); Daniel A. Dillow, New Cumberland, PA (US); Mark J. Pelletier, Shermansdale, PA (US); Wayne S. Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 57 days.

(21) Appl. No.: 13/169,669

(22) Filed: Jun. 27, 2011

(65) Prior Publication Data

US 2012/0329305 A1 Dec. 27, 2012

(51) Int. Cl.
*H01R 13/627* (2006.01)

(52) U.S. Cl.
USPC ..... 439/352; 439/357

(58) Field of Classification Search
USPC ..... 439/350–358, 372; 385/88, 92
See application file for complete search history.

(56) References Cited

U.S. PATENT DOCUMENTS

| | | | | |
|---|---|---|---|---|
| 4,787,706 | A * | 11/1988 | Cannon et al. | 385/59 |
| 5,076,656 | A * | 12/1991 | Briggs et al. | 385/71 |
| 7,008,117 | B2 * | 3/2006 | Kiani et al. | 385/58 |
| 7,281,937 | B2 | 10/2007 | Reed et al. | |
| 7,318,740 | B1 | 1/2008 | Henry et al. | |
| 7,354,292 | B1 | 4/2008 | Lloyd et al. | |
| 7,736,171 | B2 * | 6/2010 | Reed et al. | 439/352 |
| 8,167,638 | B2 * | 5/2012 | Wojcik et al. | 439/352 |
| 8,231,400 | B2 * | 7/2012 | Phillips et al. | 439/357 |
| 2002/0193016 | A1 * | 12/2002 | Bradley et al. | 439/790 |

* cited by examiner

*Primary Examiner* — Thanh Tam Le

(57) ABSTRACT

A cable connector is provided including a cable end to couple to a cable, and a mating end to couple to a corresponding connector. A latch is positioned proximate to the mating end to secure the cable connector to the corresponding connector. The latch is moveable between an open position and a closed position. An actuator is provided to move the latch between the open position and the closed position. The actuator includes a biasing end that engages the latch. The actuator also includes an operating end extending from the cable end to receive an opening force that moves the biasing end to operate the latch. The operating end has an upper tab and a lower tab. The upper tab extends along an upper portion of the cable. The lower tab extends along a lower portion of the cable.

20 Claims, 10 Drawing Sheets

ACTUATOR FOR A CONNECTOR

BACKGROUND OF THE INVENTION

The subject matter described herein relates to an actuator for a connector.

Cable assemblies generally include connectors for coupling cables and/or coupling a cable to an electronic component. The connector includes a cable end that is joined to an end of a cable. A mating end of the connector includes a mating interface to couple the connector to a corresponding connector and/or an electronic component. The connector may include a latch assembly or the like to secure the connector to the corresponding connector and/or electronic component. The latch assembly includes coupling mechanisms that engage corresponding mechanisms on the other connector. The latch assembly is moved between an open position and a closed position. In the closed position, the coupling mechanisms engage the corresponding mechanisms of the other connector to secure the connector to the other connector. In the open position, the coupling mechanisms are disengaged from the other connector to enable the connector to be coupled to and/or removed from the other connector. Generally, the connector includes an actuator to move the latch assembly between the open position and the closed position. The actuator operates the latch assembly by providing a force on the actuator.

However, conventional connectors are not without their disadvantages. Typically, the actuator includes a tab or the like for providing force on the actuator. Generally, the tab extends from the connector along a side of the cable. Unfortunately, when the connector is coupled to an electronic component, the connector may only be capable of being coupled to the electronic component in a single orientation. Often, the orientation of the connector limits access to the actuator. Accordingly, the actuator may not be accessible to an operator, when the operator removes the connector from the electronic component.

A need remains for a connector that is easily removed from an electronic component and/or corresponding connector. A need remains for a connector having an actuator that is accessible when the connector is coupled to an electronic component and/or corresponding connector.

SUMMARY OF THE INVENTION

In one embodiment, a cable connector is provided having a connector body extending between a cable end and a mating end. The cable end is configured to be coupled to a cable. The mating end is configured to be coupled to a corresponding connector. A latch positioned proximate to the mating end to secure the cable connector to the corresponding connector. The latch is moveable between an open position and a closed position. An actuator moves the latch between the open position and the closed position. The actuator extends between a biasing end that engages the latch, and an operating end opposite the biasing end. The operating end of the actuator extends from the cable end and is configured to be grasped by an operator to receive an opening force that moves the biasing end to operate the latch. The operating end has an upper tab and a lower tab. The upper tab extends along an upper portion of the cable. The lower tab extends along a lower portion of the cable.

In one embodiment, a cable connector is provided having a connector body extending between a cable end and a mating end. The cable end is configured to be coupled to a cable. The mating end is configured to be coupled to a corresponding connector. A latch is positioned proximate to the mating end to secure the cable connector to the corresponding connector. The latch is moveable between an open position and a closed position. An actuator moves the latch between the open position and the closed position. The actuator extends between a biasing end that engages the latch, and an operating end opposite the biasing end. The operating end of the actuator extends from the cable end and is configured to be grasped by an operator to receive an opening force that moves the biasing end to operate the latch. The operating end has more than one tab for receiving the opening force. Each tab extends along a different portion of the cable.

In one embodiment, a cable connector is provided including a cable end to couple to a cable, and a mating end to couple to a corresponding connector. A latch is positioned proximate to the mating end to secure the cable connector to the corresponding connector. The latch is moveable between an open position and a closed position. An actuator is provided to move the latch between the open position and the closed position. The actuator includes a biasing end that engages the latch. The actuator also includes an operating end extending from the cable end to receive an opening force that moves the biasing end to operate the latch. The operating end has an upper tab that extends along an upper portion of the cable and a lower tab that extends along a lower portion of the cable. A portion of the lower tab extends at a non-orthogonal angle with respect to the upper tab. Another portion of the lower tab extends substantially parallel to the upper tab. A cable opening is formed in the lower tab to receive the cable therethrough.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
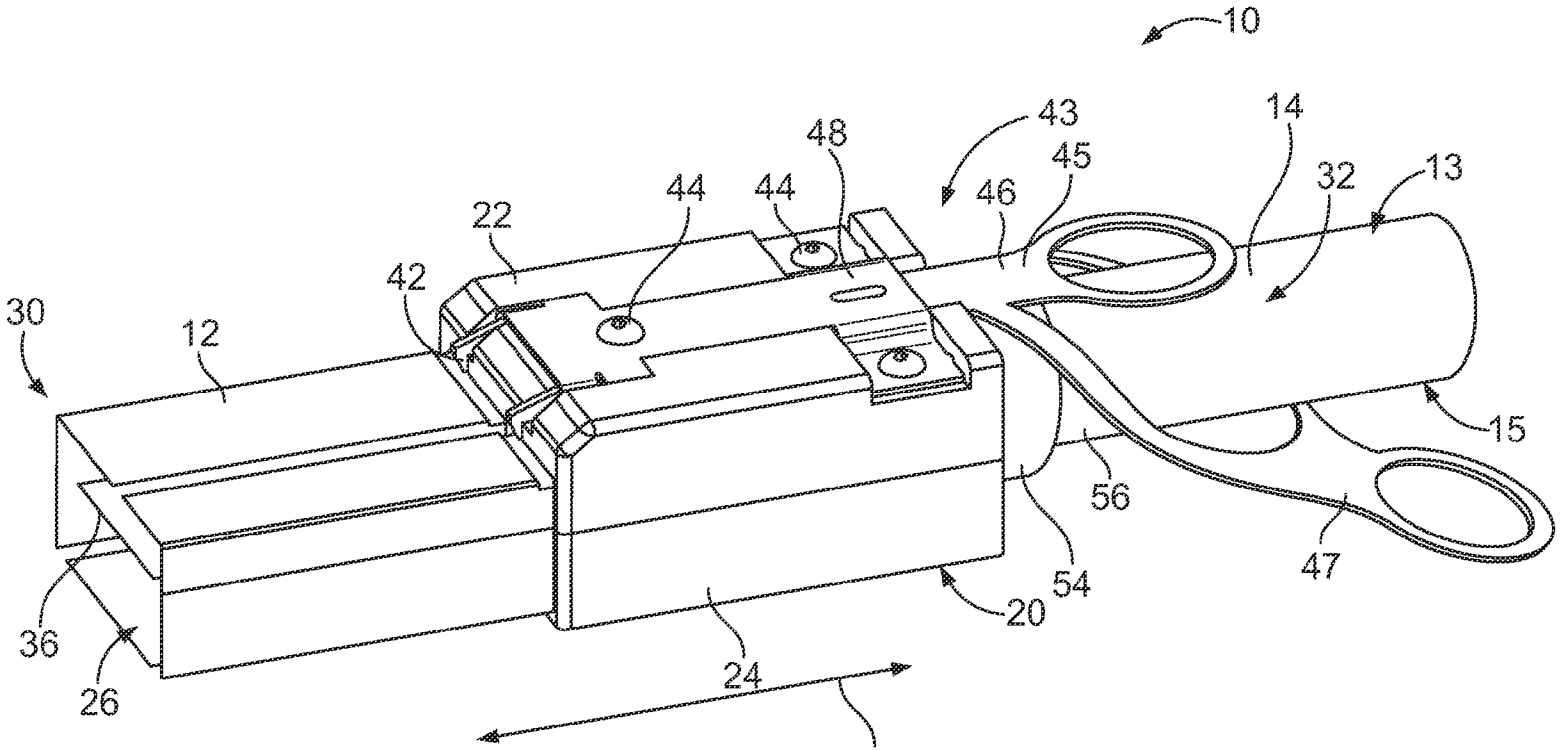
FIG. 1 is a side perspective view of a cable assembly formed in accordance with an exemplary embodiment.

FIG. 1 is a view of a cable assembly 10 formed in accordance with an exemplary embodiment. The cable assembly 10 includes a connector 12 mounted to an end of a cable 14. The cable 14 includes a first side 13 and a second side 15 that is opposite the first side 13. The connector 12 is configured to be pluggably connected to an electronic device, such as into a circuit board mounted receptacle connector or into a cable mounted receptacle connector. Optionally, the connector 12 may be constructed according to a particular standard, such as the Small Form-factor Pluggable (SFP) module standard, defining size and compatibility requirements. In alternative embodiments, the subject matter herein may be used in other types of cable mounted connectors.

The cable assembly 10 includes a housing 20 having an upper shell 22 and a lower shell 24 coupled together to define a cavity 26 therebetween. The cavity 26 extends along a longitudinal axis 28 between a mating end 30 and a cable end 32. The cable assembly 10 includes one or more circuit board(s) 36 received in the cavity 26 proximate to the mating end 30. The circuit boards 36 define a mating interface for mating with a mating connector (not shown). The circuit boards 36 are terminated to one or more conductor(s) of the cable 14. For example, the cable 14 may include a center conductor terminated to one or more of the circuit boards 36. In an alternative embodiment, rather than circuit boards 36, the cable assembly 10 may include individual contacts arranged proximate to the mating end 30 for mating with a corresponding mating connector. The individual contacts may be terminated to ends of individual conductors, for example, wires of the cable 14.

The cable 14 is secured to the connector 12 using a retainer 54. The retainer 54 couples to the connector 12 and also engages an outer jacket 56 of the cable 14 to secure the jacket 56 relative to the housing 20. In an exemplary embodiment, the retainer 54 is manufactured from a dielectric material, such as a plastic or a rubber material. The retainer 54 is secured to the jacket 56 during an overmolding process. In an alternative embodiment, the retainer 54 is secured to the jacket 56 by a bonding operation. The retainer 54 may be secured to the jacket 56 by other processes in other alternative embodiments. Optionally, rather than being manufactured from a dielectric material, the retainer 54 may be manufactured from a metal material. The retainer 54 may be secured to the jacket 56 by a crimping operation.

The cable assembly 10 includes a latch 42 for securely coupling the connector 12 to the mating connector. An actuator 46 for operating the latch 42 extends from near the cable end 32. The actuator 46 includes an operating end 43 having a first tab 45 and a second tab 47. The first tab 45 extends along the first side 13 of the cable 14 and the second tab 47 extends along the second side 15 of the cable 14. It should be noted, that although the tabs 45 and 47 of the actuator 46 are illustrated as extending along opposite sides of the cable 14, the tabs 45 and 47 of the actuator 46 may extend along any sides of the cable 14, for example, adjacent sides. In one embodiment, the actuator 46 may include any number of tabs extending along any portion of the cable 14. The latch 42 and the actuator 46 may be secured to the housing 20 using an actuator guide 48. The actuator guide 48 is positioned over the latch 42 and the actuator 46. The actuator guide 48 may be secured to the housing 20 using fasteners 44. The fasteners 44 may also be used to securely couple the upper shell 22 to the lower shell 24. The latch 42 is biased into a closed position. In the closed position, the latch 42 opposes load forces that may be imposed on either the cable assembly 10 and/or the mating connector. The latch 42 imposes a latching force on the mating connector to overcome the load forces and prevent the mating connector from moving relative to the cable assembly 10. The load forces may be generated substantially parallel to the longitudinal axis 28 in the mating end 30, in which case the latching force generated by the latch 42 is substantially parallel to the longitudinal axis 28 in a direction of the cable end 32.

To release the latch 42, a release force is directly or indirectly applied to at least one of the tabs 45 and 47 of the actuator 46 in the direction of the cable end 32. The actuator 46 engages the latch 42 to overcome the force of a biasing mechanism 90 so that the latch 42 is moved into an open position, wherein the cable assembly 10 is disconnected from the mating connector. When the release force is removed from the actuator 46, the actuator moves back into a closed position.

Figure 2:
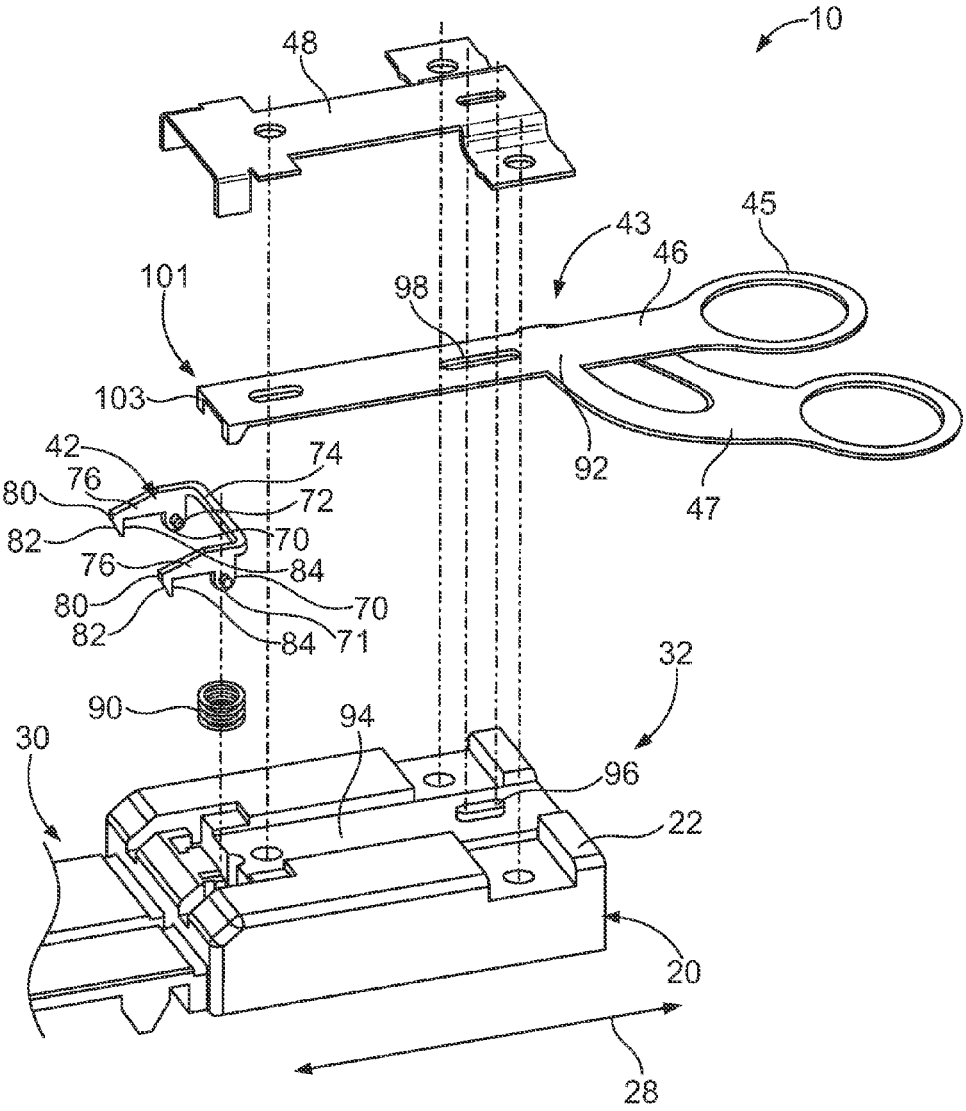
FIG. 2 is an exploded view of the cable assembly shown in FIG. 1.

FIG. 2 is an exploded view of the cable assembly 10 shown in FIG. 1. The latch 42 is coupled to the housing 20 and is configured to engage the mating connector (not shown) to secure the cable assembly 10 and the mating connector together. For example, the latch 42 may prevent the cable assembly 10 from being moved relative to the mating connector along a direction of a load force 220 (shown in FIG. 6) that may be imposed on the mating connector and/or the cable assembly 10.

The latch 42 includes pivotable bases 70 and one or more anchor points. In an exemplary embodiment, the anchor points may be axles 72. Alternatively, the anchor points may be any suitable mechanism for anchoring the latch 42. In an illustrated embodiment, an axle 72 extends from each base 70. The axle 72 may extend through each base 70. Optionally, the axle 72 may extend from a side of the base 70 or be positioned within a cavity formed in the base 70. The bases 70 have rounded ends 71 to allow rotation of the bases 70 relative to the upper shell 22. The upper shell 22 may include rounded cavities to receive the rounded ends 71. The rounded ends 71 rotate within the rounded cavities. In the exemplary embodiment, the bases 70 rotate about the axles 72. Alternatively, the latch 42 may not include axles 72, but rather the bases 70 are otherwise retained in the rounded cavity such that the rounded ends rotate within the rounded cavity. In another embodiment, the bases 70 may not include rounded ends 71 and rotate only with respect to the axles 72 without contacting the upper shell 22. The axle 72 is separate and discrete from the base 70 and is coupled to the base 70. Alternatively, the axle 72 may be formed integrally with the base 70. In the exemplary embodiment, the latch 42 includes two bases 70 and two axles 72. However, the latch 42 may include any number of bases 70 and axles 72. For example, the latch 42 may include a single base 70 centered with respect to the upper shell 22, or the latch 42 may include more than two bases 70 to support the latch 42. In an embodiment having a plurality of bases 70, only some of the bases 70 may include axles 72.

A crossbar 74 extends between and couples the bases 70. The crossbar 74 may also be configured to extend past the bases 70. In an embodiment having a single base 70, the crossbar 74 may be configured as a tab extending from the base 70. The crossbar 74 is provided rearward of the axles 72 toward the cable end 32 with respect to the axles 72. The distance between the axles 72 and the crossbar 74 defines a moment arm that controls the operation of the latch 42 when a force is transferred to the crossbar 74 via the actuator 46. The greater the moment arm required to overcome a load capacity of a biasing mechanism 90, the further rearward the crossbar 74 may be positioned from the axles 72. The crossbar 74 may also include a cavity to receive the biasing mechanism 90. Optionally, the crossbar 74 may include a slot, tab, notch, or any other suitable coupling mechanism to couple to the biasing mechanism 90.

Arms 76 extend from the bases 70 toward the mating end 30 of the cable assembly 10. Each arm 76 is positioned on a side of the base 70 that is opposite to the crossbar 74. The lengths of the arms 76 may be selected based, at least in part, on a moment arm necessary to create a latch force on the mating connector. Additionally, the lengths of the arms 76 depends on the position of a latch cavity (not shown) provided on a mating connector (not shown). Optionally, there may be a single arm or more than two arms, and some of the arms 76 may have different lengths than other arms 76. Alternatively, the arms 76 may extend from the crossbar 74 rather than the bases 70. In another embodiment, the latch 42 may include a second crossbar positioned toward the mating end 30 of the bases 70. One or more arms 76 may extend from the second crossbar.

Each arm 76 includes a hook 80 at a distal end thereof for engaging a latch cavity of the mating connector. In an exemplary embodiment, the hooks 80 and axles 72 are in a plane that is parallel to the longitudinal axis 28 when the latch is in the closed position. When the latch 42 is rotated into the open position, the hook 80 and axles 72 are positioned in a plane that extends at an angle with respect to the longitudinal axis 28. In the closed position, the hook 80 and the axles 72 are capable of providing a latch force that extends along the longitudinal axis 28.

Each hook 80 includes a angled front end 82 that is configured to engage the mating connector when the mating connector is coupled to the connector 10. During coupling, the angled front end 82 operates as a ramp to bias the latch 42 into an open position. Each hook 80 also includes a latch point configured to engage the mating connector. In the illustrated embodiment, the latch point is a flat catch surface 84 at an end of the hook 80 toward the cable end 32. Alternatively, the latch 42 may include any suitable latch point for engaging the mating connector. The catch surface 84 is received within the latch cavity when the cable assembly 10 is coupled to the mating connector. The flat catch surface 84 may also include a tab extending toward the cable end 32 that is configured to catch a lip or notch formed in the latch cavity. Optionally, the hooks 80 may be sized to create an interference fit with the latch cavity, wherein the hooks 80 are retained within the latch cavity via friction. In another embodiment, the hooks 80 may include teeth that engage the side of the latch cavity or notches formed in the latch cavity.

The latch 42 is positioned within the upper shell 22 of the cable assembly 10 via the axles 72. Alternatively, the bases 70 may retain the position of the latch 42 within the upper shell 22. The latch 42 is configured to rotate about the axles 72 between the open position and the closed position. The latch 42 may also rotate about the rounded ends 71 of the base 70. In one embodiment, the latch 42 rotates within a range between 0 degrees and 90 degrees with respect to the longitudinal axis 28, wherein the latch 42 is in the closed position and parallel to the longitudinal axis 28 at 0 degrees. Additionally, the latch 42 may close at an angle that is not parallel to the longitudinal axis 28. For example, the closed position of the latch 42 may be −10 degrees with respect to the longitudinal axis 28.

In the open position, the hooks 80 of the latch 42 are positioned away from the connector 12 and, if coupled, the mating connector. In the closed position, the hooks 80 of the latch 42 are positioned near to or in contact with the connector 12 and, if coupled, the mating connector. The biasing mechanism 90 biases the latch 42 in the closed position and is positioned in contact with the crossbar 74 to bias the latch 42 into the closed position. The biasing mechanism 90 may be positioned flush with the crossbar 74 and/or be coupled thereto using any suitable coupling mechanism. In the exemplary embodiment, the biasing mechanism 90 is a spring. Alternatively, the biasing mechanism 90 may be any mechanism capable of biasing the latch 42 in the closed position. The biasing mechanism 90 is selected and sized based on a required load capacity to offset the load force 156 such that such load force 156 does not cause the latch 42 to disengage from the latch cavities 154. The latch 42 may also include any number of biasing mechanisms to offset the load force 156.

The actuator 46 includes a biasing end 101 extending from the operating end 43. The biasing end 101 operates the latch 42. In the illustrated embodiment, the biasing end 101 includes ramps 103 configured to engage the crossbar 74 of the latch 42. The ramps 103 are configured to bias the crossbar 74 against the biasing mechanism 90. At least one of the tabs 45 and 47 of the actuator 46 may be utilized to apply force to the actuator 46. A user applies force to the actuator 46 by pulling at least one of the tabs 45 and 47 along the longitudinal axis 28 in the direction of the cable end 32. As the force is applied, the ramps 100 engage the crossbar 74 of the latch 42 to counteract the force of biasing mechanism 90. The latch 42 is rotated into the open position to disengage the hooks 80 of the latch 42 from the latch cavity of the mating connector.

The actuator guide 48 retains the actuator 46 within a groove 94 of the upper shell 22. The actuator guide 48 also retains the latch 42 and the biasing mechanism 90 within the upper shell 22. The actuator guide 48 is secured to the upper shell 22 with fasteners 44. The actuator 46 includes an elongated portion 92 that extends along the groove 94. The groove 94 includes a positioning tab 96 and the actuator 46 includes a positioning slot 98. The positioning slot 98 engages the positioning tab 96 to guide the actuator 46 as the actuator 46 slides through groove 94. The actuator 46 is configured to slide along the longitudinal axis 28 within actuator guide 48 and the groove 94.

It should be noted that the cable assembly 10 described above is exemplary only and the actuators described herein may be utilized with any cable assembly having any connector or latch assembly.

Figure 3:
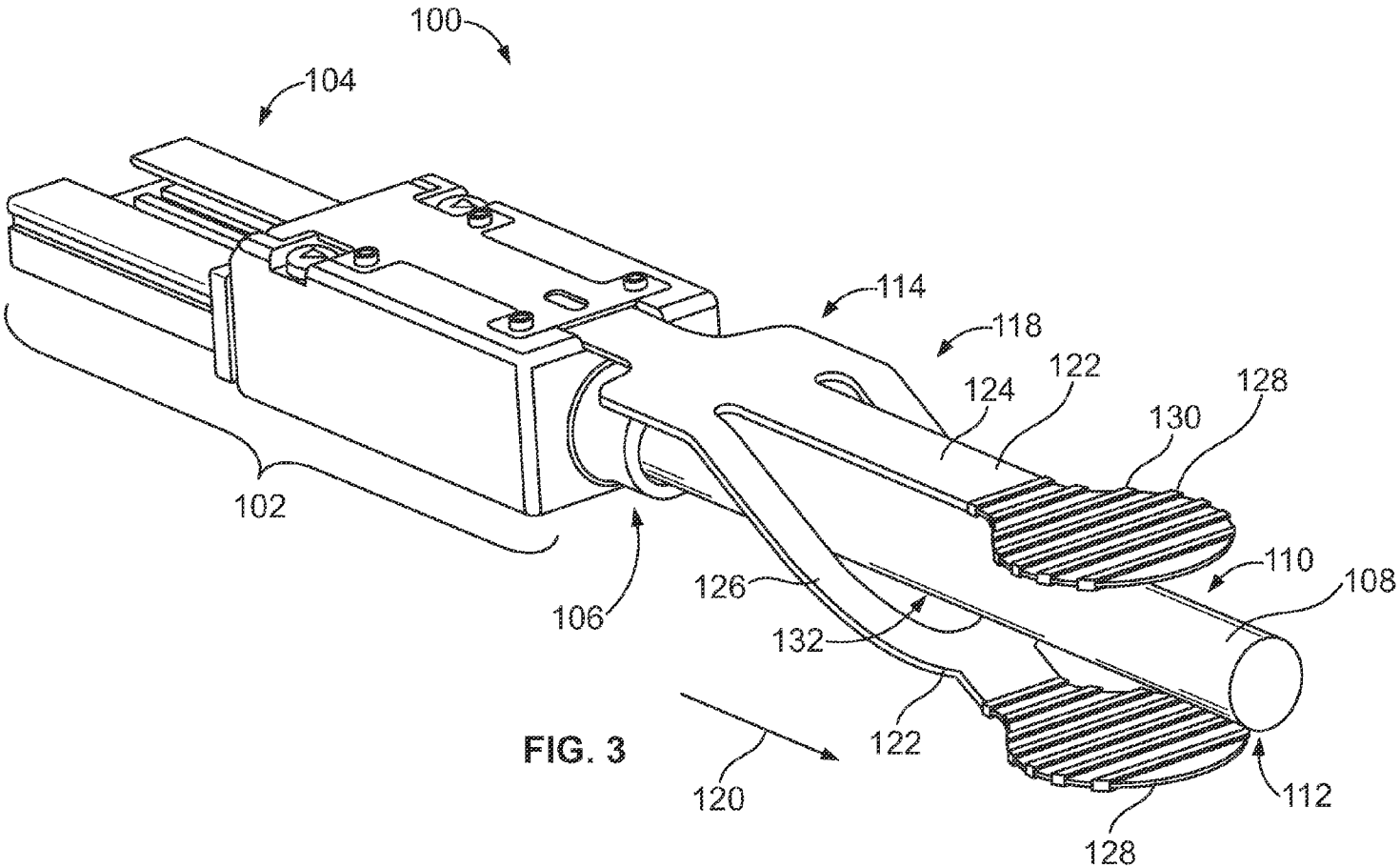
FIG. 3 is a side perspective view of a cable assembly formed in accordance with another embodiment.

FIG. 3 is a side perspective view of a cable assembly 100 formed in accordance with another embodiment. The cable assembly includes a cable connector 102 having a mating end 104 and a cable end 106. A cable 108 extends from the cable end 106. The cable 108 includes an upper portion 110 and a lower portion 112. It should be noted that although the cable 108 is described with respect to an upper portion 110 and a lower portion 112, one of skill would recognize that the cable assembly 100 may be oriented such that the upper portion 110 and the lower portion 112 are oriented as side portions or within an intermediate position between an upper position and a lower position. The cable connector 102 includes a latch or other coupling device (not shown), for example, the latch 42 shown in FIG. 2.

An actuator 114 extends from the cable connector 102. The actuator 114 includes a biasing end 116 (shown in FIG. 4) and an operating end 118. The biasing end 116 engages the latch 42. The operating end 118 extends from the cable end 106 of the cable connector 102 to receive an opening force in the direction of arrow 120. The opening force moves the biasing end 116 to operate the latch. The operating end 118 includes more than one tab 122. Each tab 122 extends along a different portion of the cable 108. The operating end 118 may include any number of tabs 122 that extend along any portion of the cable 108. In the illustrated embodiment, the operating end 118 includes an upper tab 124 and a lower tab 126. It should be noted that although the operating end 118 is described with respect to an upper tab 124 and a lower tab 126, one of skill would recognize that the cable assembly 100 may be oriented such that the upper tab 124 and the lower tab 126 are oriented as side tabs or within an intermediate position between an upper position and a lower position. In an exemplary embodiment, the upper tab 124 extends along the upper portion 110 of the cable 108. In an exemplary embodiment, the lower tab 126 extends along the lower portion 112 of the cable 108. Each of the upper tab 124 and the lower tab 126 includes an engagement feature 128 for gripping the upper tab 124 and the lower tab 126. The engagement feature 128 provides a means for applying the opening force to the actuator 114. The engagement feature 128 may include ribs 130 (as illustrated) and/or any other surface feature for providing friction. In one embodiment, the engagement feature 128 may include a loop or the like.

The actuator 114 includes a cable opening 132. The cable opening 132 is provided in the operating end 118 of the actuator 114. The cable 108 extends through the cable opening 132. In one embodiment, the cable opening 132 may be formed in one of the tabs 122. For example, in the illustrated embodiment, the cable opening 132 is formed in the lower tab 126. Alternatively, the cable opening 132 may be formed in the upper tab 124. The cable opening 132 is elongated to provide access for the cable 108. The elongated cable opening 132 prevents the lower tab 126 from binding on the cable 108 when opening force 120 is applied to the actuator 114.

Figure 4:
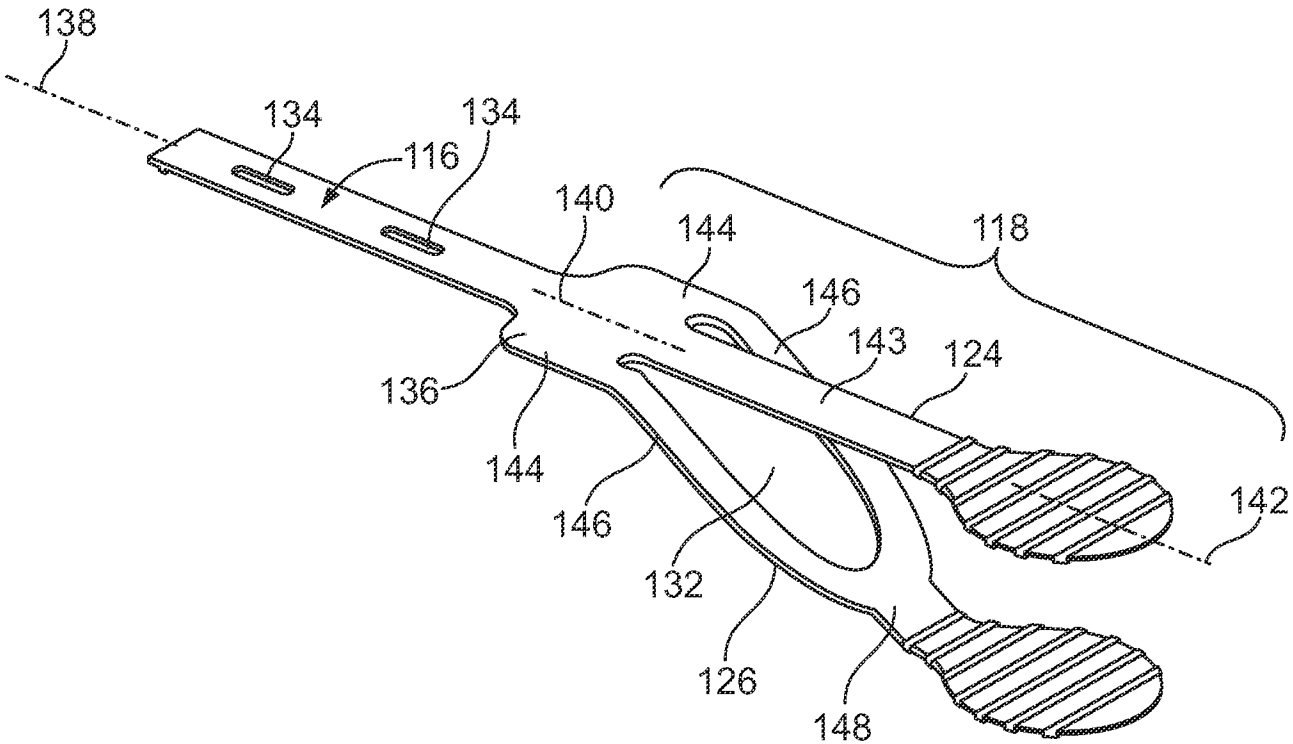
FIG. 4 is a side perspective view of an actuator formed in accordance with an embodiment.

FIG. 4 is a side perspective view of the actuator 114. The biasing end 116 includes positioning slots 134 to receive a positioning tab of an actuator guide and/or a housing of the cable connector 102, as described in FIG. 2. The positioning slots 134 are illustrated as slots. However, the positioning slots 134 may take many embodiments, for example, tabs, flanges, or the like.

The operating end 118 extends from the biasing end 116. In an exemplary embodiment, the operating end 118 and the biasing end 116 are integrally formed. Optionally, the operating end 118 and the biasing end 116 may include multiple pieces that are secured together using any suitable securing or coupling means. The operating end 118 includes base 136 that is joined to the biasing end 116. The upper tab 124 and the lower tab 126 extend from the base 136. In the illustrated embodiment, the upper tab 124 and the lower tab 126 are integrally formed. In the illustrated embodiment, the upper tab 124 and the lower tab 126 are integrally formed with the base 136. Optionally, the base 136, the upper tab 124 and the lower tab 126 may be formed as separate pieces that are joined together using any suitable securing or coupling means.

The biasing end 116 includes a centerline 138. The base 136 includes a centerline 140 that is aligned with the centerline 138 of the biasing end 116. The upper tab 124 extends along the centerline 138 of the biasing end 116 and the centerline 140 of the base 136. The upper tab 124 includes a centerline 142 that is aligned with the centerline 138 of the biasing end 116 and the centerline 140 of the base 136. The base 136 includes sides 144 on each side of the centerline 140. The sides 144 are positioned outward from the centerline 140.

The lower tab 126 includes coupling ends 146. The coupling ends 146 join the lower tab 126 to the base 136. Each coupling end 146 is joined to a side 144 of the base 136. The coupling ends 146 are positioned outward from the centerline 140 of the base 136 and the centerline 142 of the upper tab 124. The coupling ends 146 are positioned on opposite sides of the upper tab 124. The coupling ends 146 extend downward from the base 136 and toward one another. The coupling ends 146 extend in the direction of the centerline 142 of the upper tab 124. The coupling ends 146 are joined together at an intersection 148 that is proximate to the engagement feature 128 of the lower tab 126.

In the illustrated embodiment, the cable opening 132 is formed in the lower tab 126. The cable opening 132 is defined by the coupling ends 146 of the lower tab 126. In one embodiment, the cable 108 (shown in FIG. 3) extends through the lower tab 126. In an exemplary embodiment, the cable 108 extends through the coupling ends 146 of the lower tab 126.

Figure 5:
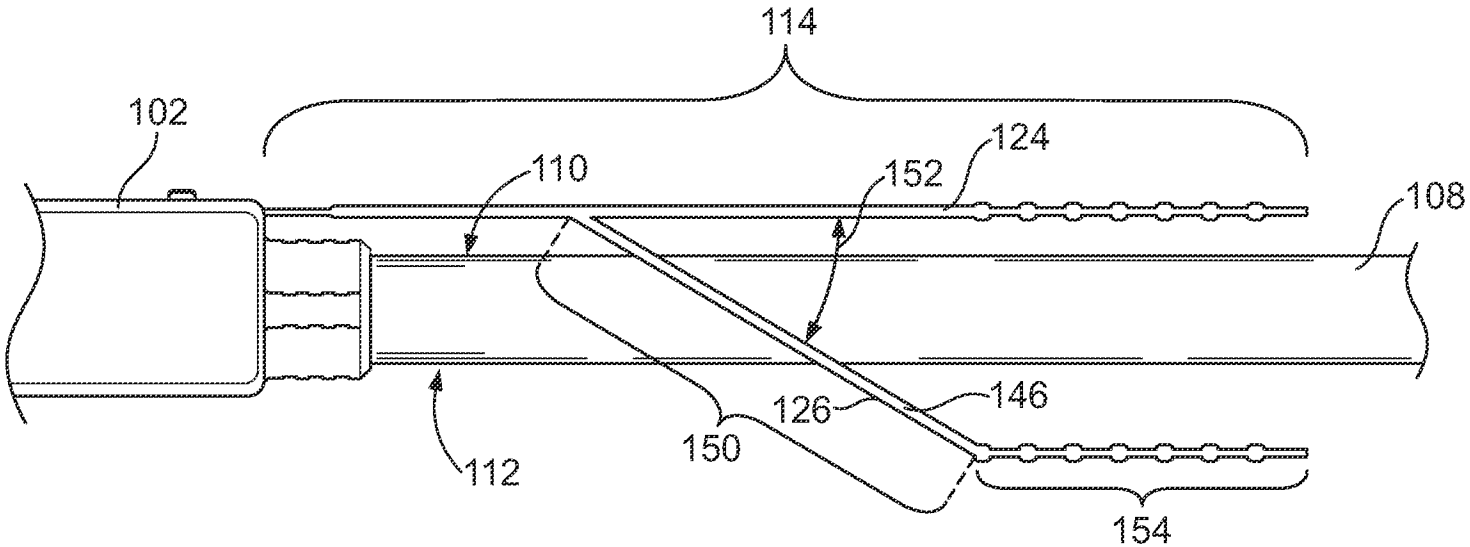
FIG. 5 is a side view of the actuator shown in FIG. 4.

FIG. 5 is a side view of the actuator 114 coupled to the cable connector 102. The cable 108 extends from the cable connector 102. The upper tab 124 of the actuator 114 extends along the upper portion 110 of the cable 108. The lower tab 126 of the actuator 114 extends along the lower portion 112 of the cable 108. The cable 108 extends through the lower tab 126 of the actuator 114. The cable 108 extends between the coupling ends 146 of the lower tab 126. A portion 150 of the lower tab 126 extends at a non-orthogonal angle 152 with respect to the upper tab 124. For example, the angle 152 may be an approximately thirty degree angle in one embodiment. The angle 152 is configured to reduce a necessary opening force 120 (shown in FIG. 3) that is required to activate the latch 42 (shown in FIG. 2) when the opening force 120 is applied to the lower tab 126. In one embodiment, the portion 150 primarily includes the coupling ends 146 of the lower tab 126. However, in other embodiments, the portion 150 may include any portions of the lower tab 126. In the illustrated embodiment, a portion 154 of the lower tab 126 extends substantially parallel to the upper tab 124. In one embodiment, the portion 154 primarily includes the engagement feature 128 of the lower tab 126. However, in other embodiments, the portion 154 may include any portions of the lower tab 126.

Figure 6:
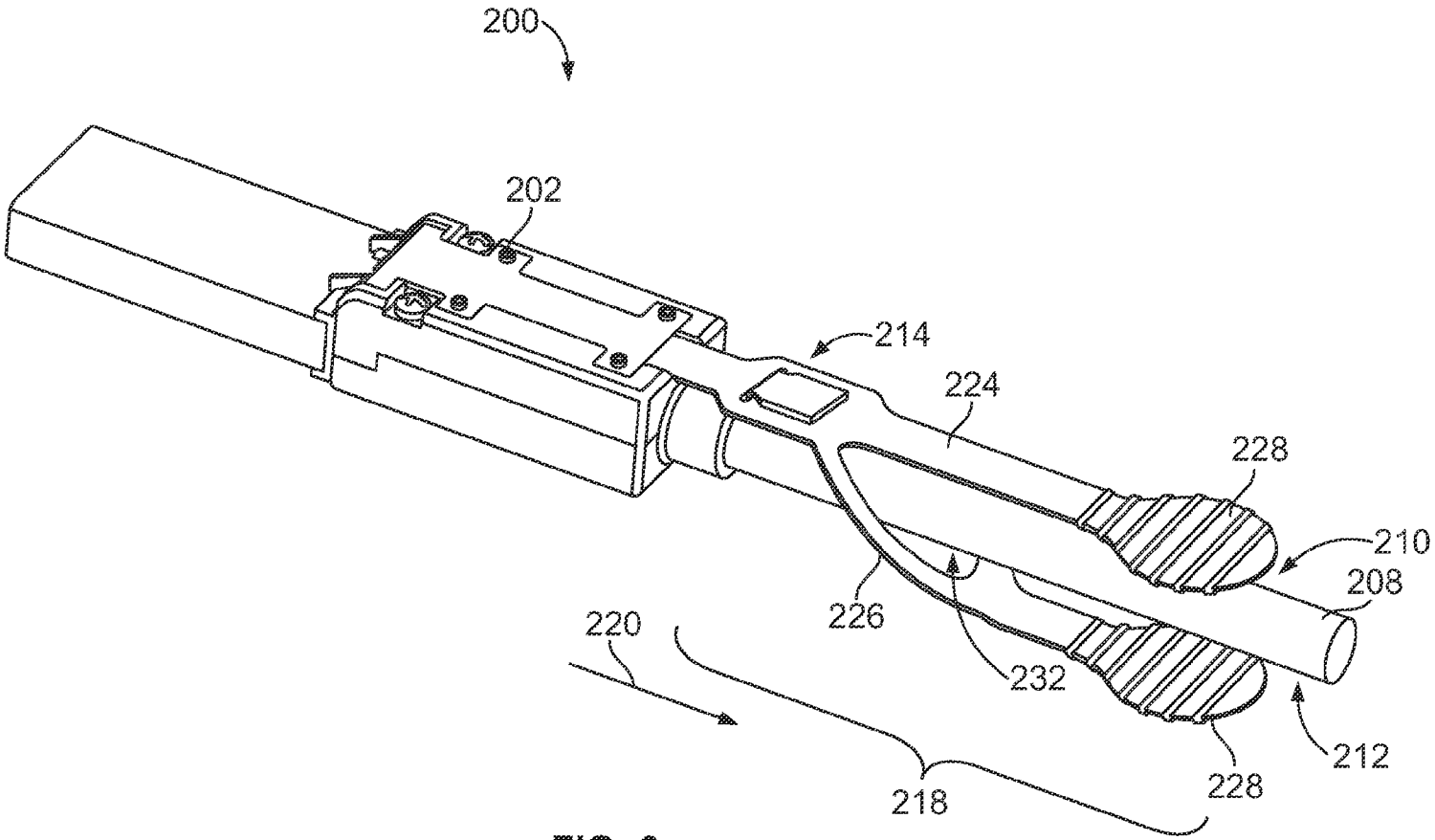
FIG. 6 is a side perspective view of a cable assembly formed in accordance with another embodiment.

FIG. 6 is a side perspective view of a cable assembly 200 formed in accordance with another embodiment. The cable assembly includes a cable connector 122 having a cable 208 extending therefrom. The cable 208 includes an upper portion 210 and a lower portion 212. The cable connector 122 includes a latch or other coupling device (not shown), for example, the latch 42 shown in FIG. 2.

An actuator 214 extends from the cable connector 122. The actuator 214 includes a biasing end 216 (shown in FIG. 7) and an operating end 218. The biasing end 216 engages the latch 42. The operating end 218 is configured to receive an opening force in the direction of arrow 220 to operate the latch. The operating end 218 includes an upper tab 224 and a lower tab 226. In an exemplary embodiment, the upper tab 224 extends along the upper portion 210 of the cable 208. In an exemplary embodiment, the lower tab 226 extends along the lower portion 212 of the cable 208. Each of the upper tab 224 and the lower tab 226 includes an engagement feature 228 for gripping the upper tab 224 and the lower tab 226 to provide the opening force.

The actuator 214 includes a cable opening 232. The cable opening 232 is provided in the operating end 218 of the actuator 214. The cable 208 extends through the cable opening 232. In one embodiment, the cable opening 232 may be formed in one of the upper tab 224 and/or the lower tab 226.

For example, in the illustrated embodiment, the cable opening 232 is formed in the lower tab 226. Alternatively, the cable opening 232 may be formed in the upper tab 224. The cable opening 232 is elongated to provide access for the cable 208. The elongated cable opening 232 prevents the lower tab 226 from binding on the cable 208 when opening force 120 is applied to the actuator 214.

Figure 7:
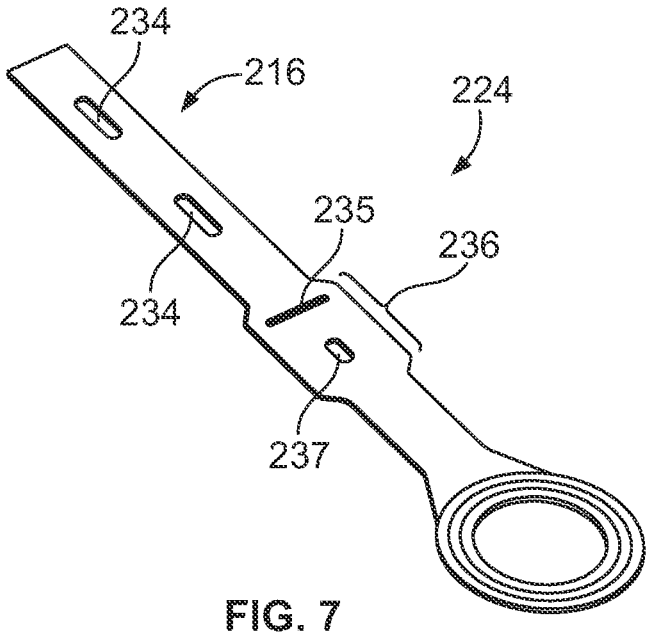
FIG. 7 is a top perspective view of an actuator tab formed in accordance with an embodiment.

FIG. 7 is a top perspective view of the upper tab 224. The biasing end 216 of the actuator 214 (shown in FIG. 6) is formed integrally with the upper tab 224. The biasing end 216 includes positioning slots 234 to receive a positioning tab of an actuator guide and/or a housing of the cable connector 122, as described in FIG. 2. A base 236 is formed integrally with and positioned between the biasing end 216 and the upper tab 224. The base 236 includes a lower tab opening 235 and a rivet opening 237.

Figure 8:
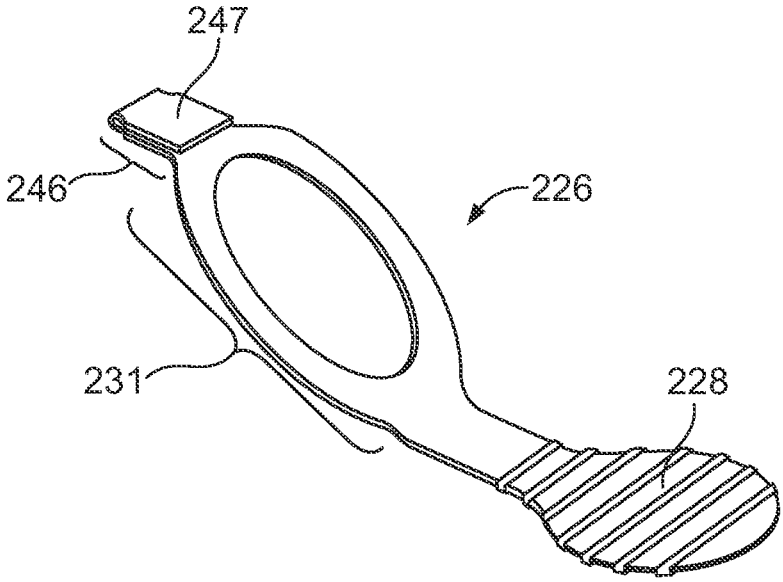
FIG. 8 is a top perspective view of another actuator tab formed in accordance with an embodiment.

FIG. 8 is a top perspective view of the lower tab 226. The lower tab 226 includes a coupling end 246. The coupling end 246 joins the lower tab 226 to the base 236 (shown in FIG. 7). The coupling end 246 is configured to extend through the lower tab opening 235 (shown in FIG. 7) in the base 236. The coupling end 246 includes a rivet opening 247. The rivet opening 247 is configured to be aligned with the rivet opening 237 (shown in FIG. 7) of the base 236. The rivet openings 237 and 247 are configured to receive a rivet or the like therethrough to secure the coupling end 246 of the lower tab 226 to the base 236.

A cable receptor portion 231 of the lower tab 226 extends from the coupling end 246. The cable receptor portion 231 is positioned between the coupling end 246 and the engagement feature 228. In the illustrated embodiment, the cable opening 232 is formed in the cable receptor portion 231. In one embodiment, the cable 208 (shown in FIG. 6) extends through the lower tab 226. In an exemplary embodiment, the cable 208 extends through the cable receptor portion 231 of the lower tab 226.

Figure 9:
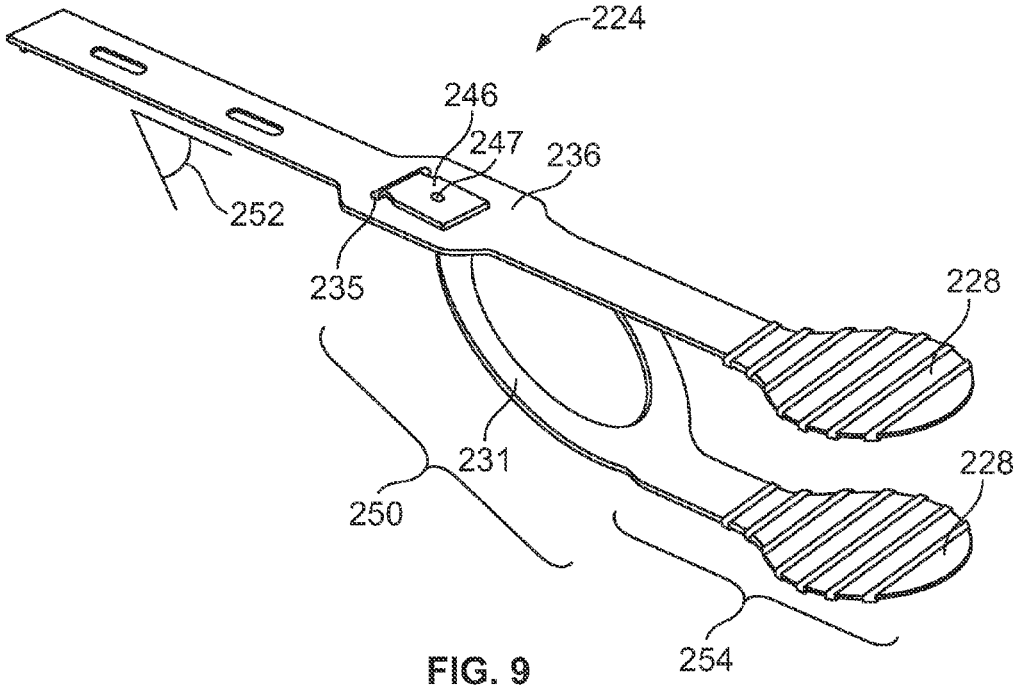
FIG. 9 is a top perspective view of an actuator formed in accordance with an embodiment and including the actuator tab shown in FIG. 7 coupled to the actuator tab shown in FIG. 8.

FIG. 9 is a top perspective view of the lower tab 226 coupled to the upper tab 224. The coupling end 246 of the lower tab 226 is inserted into the lower tab opening 235 of the base 236. The coupling end 246 is folded over so that the rivet opening 247 is aligned with the rivet opening 237 (shown in FIG. 7) of the base 236 (as illustrated in FIG. 10).

A portion 250 of the lower tab 226 extends at a non-orthogonal angle 252 with respect to the upper tab 224. For example, the angle 252 may be an approximately thirty degree angle in one embodiment. The angle 252 is configured to reduce a necessary opening force 220 (shown in FIG. 6) that is required to activate the latch 42 (shown in FIG. 2) when the opening force 220 is applied to the lower tab 226. In one embodiment, the portion 250 primarily includes the cable receptor portion 231of the lower tab 226. However, in other embodiments, the portion 250 may include any portions of the lower tab 226. In the illustrated embodiment, a portion 254 of the lower tab 226 extends substantially parallel to the upper tab 224. In one embodiment, the portion 254 primarily includes the engagement feature 228 of the lower tab 226. However, in other embodiments, the portion 254 may include any portions of the lower tab 226.

Figure 10:
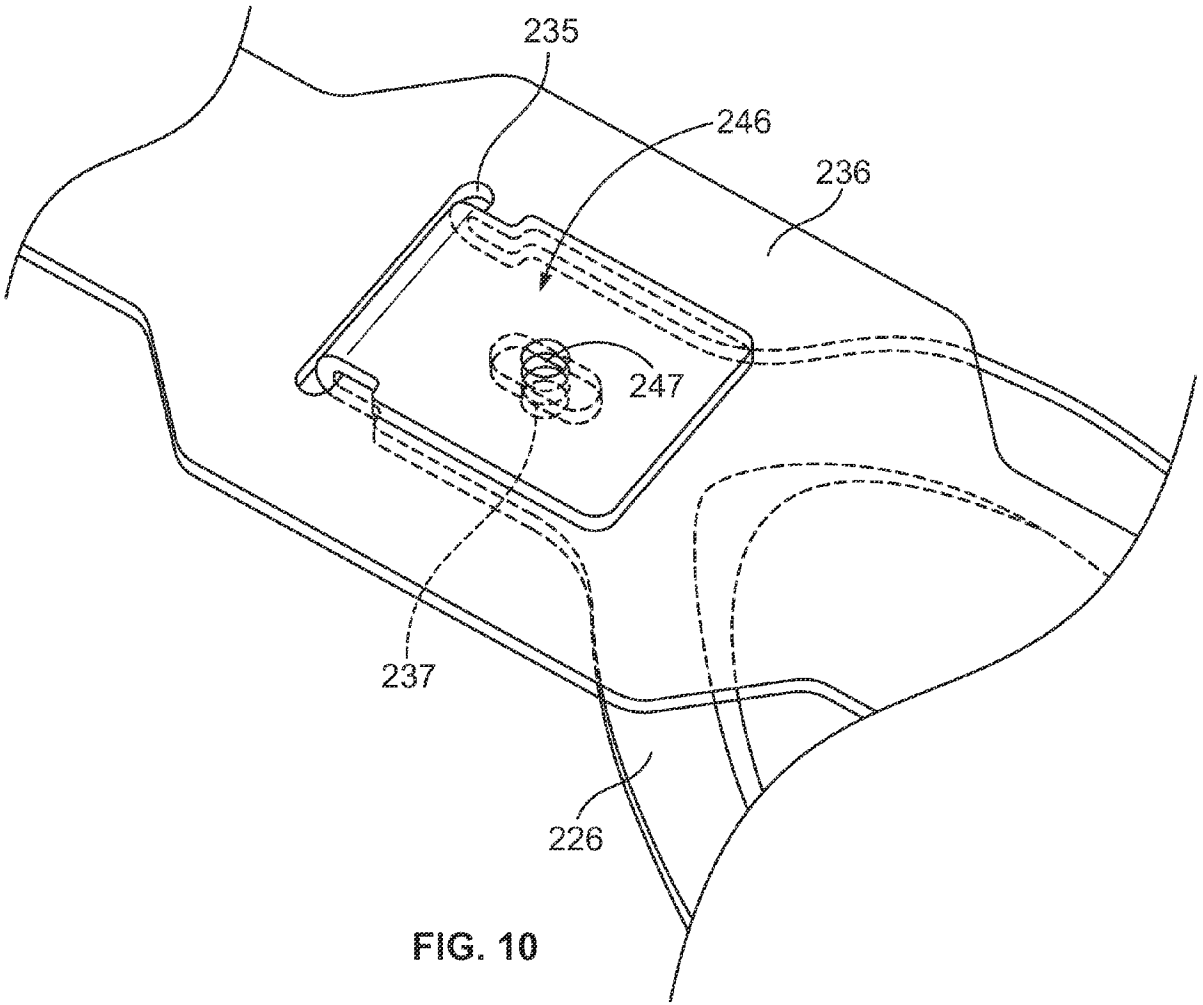
FIG. 10 is a top perspective view of the actuator tab shown in FIG. 7 coupled to the actuator tab shown in FIG. 8.

FIG. 10 is a top perspective view of the coupling end 246 of the lower tab 226 inserted into the lower tab opening 235 of the base 236. The coupling end 246 is folded over so that the rivet opening 247 is aligned with the rivet opening 237 of the base 236. The rivet openings 237 and 247 are configured to receive a rivet or the like therethrough to secure the coupling end 246 of the lower tab 226 to the base 236. In one embodiment, the coupling end 246 may be secured to the base 236 using tape, glue, welding, or the like.

Figure 11:
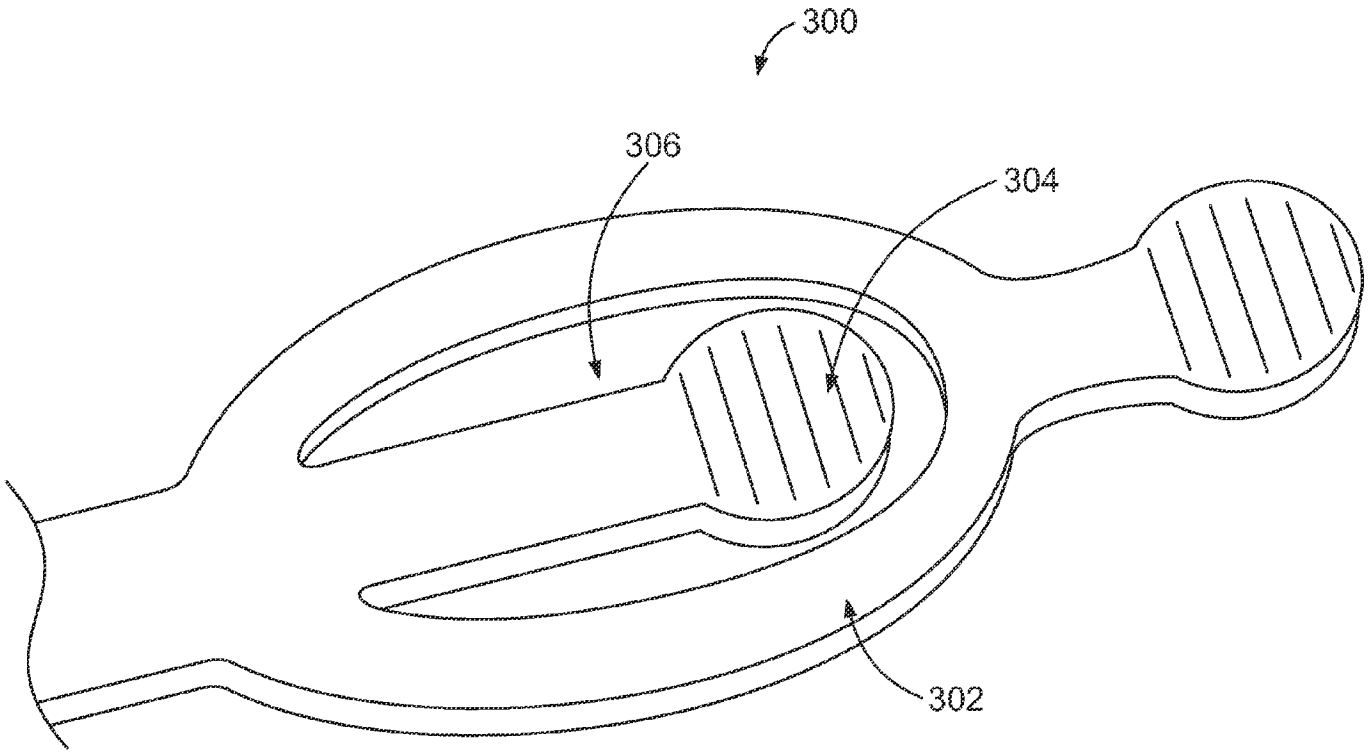
FIG. 11 is a top perspective view of another actuator formed in accordance with an exemplary embodiment.

FIG. 11 is a top perspective view of another actuator 300 formed in accordance with an exemplary embodiment. The actuator 300 may be stamped, molded, or the like in a flat configuration as shown in FIG. 11. The actuator 300 may be formed from a metal or plastic. The actuator 300 includes a lower tab 302 formed integrally with an upper tab 304. In the illustrated embodiment, the lower tab 302 is formed with a cable opening 306. The upper tab 304 is formed within the cable opening 306 of the lower tab 302. During assembly of a connector, the lower tab 302 is bent downward so that a cable of the connector is received in the cable opening 306. The lower tab 302 is bent downward to be positioned along a lower portion of the cable, and the upper tab 304 extends along an upper portion of the cable.

The embodiments described herein provide a connector including an actuator having multiple tabs for providing a force on the actuator. The actuator includes tabs that extend along different portions of a cable that is coupled to the connector. The multiple tabs allow access to the actuator regardless of the connector's orientation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A cable connector comprising:

a connector body extending between a cable end and a mating end, the cable end being configured to be coupled to a cable, the mating end being configured to be coupled to a corresponding connector;

a latch positioned proximate to the mating end to secure the cable connector to the corresponding connector, the latch moveable between an open, unlatched position and a closed, latched position; and an actuator to move the latch between the unlatched position and the latched position, the actuator extending between a biasing end that engages the latch, and an operating end opposite the biasing end, the operating end of the actuator extending from the cable end and being configured to be grasped by an operator to receive an opening force that moves the biasing end to operate the latch, the operating end having an upper tab and a lower tab, the upper tab extending along an upper portion of the cable, the lower tab extending from the upper tab and extending along a lower portion of the cable.

2. The cable connector of claim 1, wherein the upper tab is formed integrally with the lower tab.

3. The cable connector of claim 1, wherein the upper tab is formed integrally with the biasing end, the lower tab coupled to the upper tab.

4. The cable connector of claim 1, wherein the lower tab includes a cable opening, the cable extending through the cable opening.

5. The cable connector of claim 1, wherein the upper tab includes a slot and the bottom tab includes a coupling end that extends through the slot.

6. The cable connector of claim 1, wherein the lower tab includes a transition portion extending from the upper tab at a non-orthogonal angle with respect to the upper tab and the lower tab includes a longitudinal gripping portion extending from the transition portion along the cable rearward of the transition portion, the upper tab including a longitudinal gripping portion rearward of the take-off area of the transition portion from the upper tab.

7. The cable connector of claim 1, wherein at least a portion of the lower tab extends substantially parallel to the upper tab on opposite sides of the cable, the lower tab having a transition portion extending between the upper tab and the portion of the lower tab that extends substantially parallel to the upper tab.

8. The cable connector of claim 1, wherein the lower tab includes a coupling end that receives a rivet to join the lower tab to the upper tab.

9. The cable connector of claim 1, wherein the lower tab includes coupling ends joined to opposite sides of a base of the upper tab, wherein the opening force exerted on the lower tab is transferred to the upper tab at the coupling ends to move the actuator.

10. A cable connector comprising:

a connector body extending between a cable end and a mating end, the cable end being configured to be coupled to a cable, the mating end being configured to be coupled to a corresponding connector;

a latch positioned proximate to the mating end to secure the cable connector to the corresponding connector, the latch moveable between an open, unlatched position and a closed, latched position; and an actuator to move the latch between the unlatched position and the latched position, the actuator extending between a biasing end that engages the latch, and an operating end opposite the biasing end, the operating end of the actuator extending from the cable end and being configured to be grasped by an operator to receive an opening force that moves the biasing end to operate the latch, the operating end having more than one tab for receiving the opening force, each tab extending along a different portion of the cable, at least one of the tabs being cantilevered from the other tab.

11. The cable connector of claim 10, wherein the tabs are formed integrally.

12. The cable connector of claim 10, wherein at least one tab is formed integrally with the biasing end, and at least one tab is coupled to a tab formed integrally with the biasing end.

13. The cable connector of claim 10, wherein at least one tab includes a cable opening, the cable extending through the cable opening.

14. The cable connector of claim 10, wherein at least one tab includes a slot and at least one other tab includes a coupling end that extends through the slot.

15. The cable connector of claim 10, wherein at least a portion of one of the tabs extends at a non-orthogonal angle with respect to another tab.

16. The cable connector of claim 10, wherein at least a portion of one of the tabs extends substantially parallel to one of the other tabs.

17. The cable connector of claim 10, wherein at least one of the tabs includes a coupling end that receives a rivet to secure the tab to another tab.

18. The cable connector of claim 10, wherein at least one of the tabs includes coupling ends joined to opposite sides of a base of another tab.

19. A cable connector comprising:

a cable end to couple to a cable, and a mating end to couple to a corresponding connector;

a latch positioned proximate to the mating end to secure the cable connector to the corresponding connector, the latch moveable between an open, unlatched position and a closed, latched position; and an actuator to move the latch between the unlatched position and the latched, the actuator comprising:

a biasing end that engages the latch, and an operating end extending from the cable end to receive an opening force that moves the biasing end to operate the latch, the operating end having an upper tab that extends along an upper portion of the cable and a lower tab that extends along a lower portion of the cable, a portion of the lower tab extending at a non-orthogonal angle with respect to the upper tab, another portion of the lower tab extending substantially parallel to the upper tab, a cable opening formed in the lower tab to receive the cable therethrough.

20. The cable connector of claim 19, wherein the actuator is formed in a flat configuration.

* * * * *